US009162243B2

(12) United States Patent
Pei et al.

(10) Patent No.: US 9,162,243 B2
(45) Date of Patent: Oct. 20, 2015

(54) COATING AUXILIARY DEVICE

(71) Applicants: Shao-Kai Pei, New Taipei (TW); Chia-Ying Wu, New Taipei (TW); Ming-Yang Liao, New Taipei (TW)

(72) Inventors: Shao-Kai Pei, New Taipei (TW); Chia-Ying Wu, New Taipei (TW); Ming-Yang Liao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 484 days.

(21) Appl. No.: 13/663,377

(22) Filed: Oct. 29, 2012

(65) Prior Publication Data

US 2013/0340676 A1 Dec. 26, 2013

(30) Foreign Application Priority Data

Jun. 25, 2012 (TW) ..... 101122674

(51) Int. Cl.

| | |
|---|---|
| ***B05C 13/02*** | (2006.01) |
| ***B05C 11/00*** | (2006.01) |
| ***B05B 15/04*** | (2006.01) |
| ***B05C 21/00*** | (2006.01) |

(52) U.S. Cl.

CPC ..... *B05B 15/0462* (2013.01); *B05C 13/02* (2013.01); *B05C 21/005* (2013.01)

(58) Field of Classification Search

None

See application file for complete search history.

(56) References Cited

U.S. PATENT DOCUMENTS

2002/0089569 A1* 7/2002 Silverbrook ..... 347/54
2011/0283938 A1* 11/2011 Pei ..... 118/503

FOREIGN PATENT DOCUMENTS

JP 2005139493 * 6/2005 ..... C23C 14/04

* cited by examiner

*Primary Examiner* — Dah-Wei D Yuan
*Assistant Examiner* — Jethro M Pence
(74) *Attorney, Agent, or Firm* — Novak Druce Connolly Bove + Quigg LLP

(57) ABSTRACT

A coating auxiliary device, for coating hollow workpieces, includes a loading tray, masking stoppers, and an ejecting plate. The loading tray includes a loading surface, a matching surface opposite to the loading surface, and engaging portions extending up from the loading surface. Each workpiece is engaged with an engaging portion. The loading device defines guiding holes. Each guiding hole passes through an engaging portion and the matching surface and is in communication with the respective workpiece. Each masking stopper is configured to be inserted into a respective workpiece to mask an interior of the respective workpiece. The ejecting plate includes an assembling surface and ejecting rods extending up from the assembling surface. Each ejecting rod is configured to be guided into a respective guiding hole from the matching surface to eject out a respective masking stopper.

12 Claims, 5 Drawing Sheets

COATING AUXILIARY DEVICE

BACKGROUND

1. Technical Field

The present disclosure relates to a coating auxiliary device.

2. Description of Related Art

A metallic film can be coated to an exterior surface of a lens barrel for electromagnet interference (EMI) shielding function. When coating the lens barrel, one end of the lens barrel is seated on a loading plate, and a masking stopper is inserted into the other end of the lens barrel to enclose the lens barrel and prevent an inner surface of the lens barrel from being coated. After coating, the masking stopper is manually taken out from the lens barrel, which is an inefficient use of man power.

Therefore, it is desirable to provide a coating auxiliary device, which can overcome the limitations described.

DETAILED DESCRIPTION

Embodiments of the disclosure will now be described in detail, with reference to the accompanying drawings.

Figure 1:
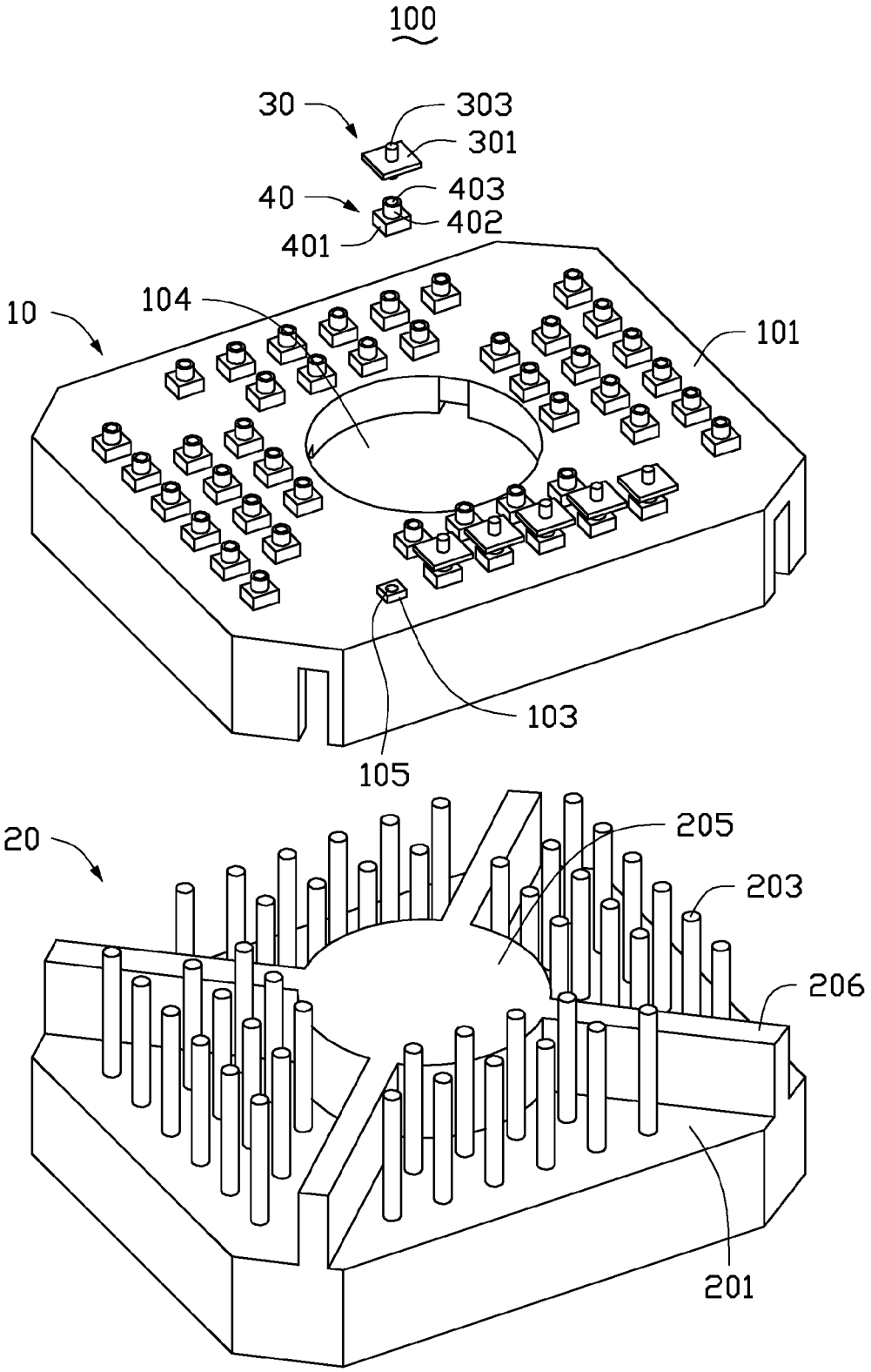
FIG. 1 is an exploded perspective view of a coating auxiliary device, in according with a first embodiment.
Figure 2:
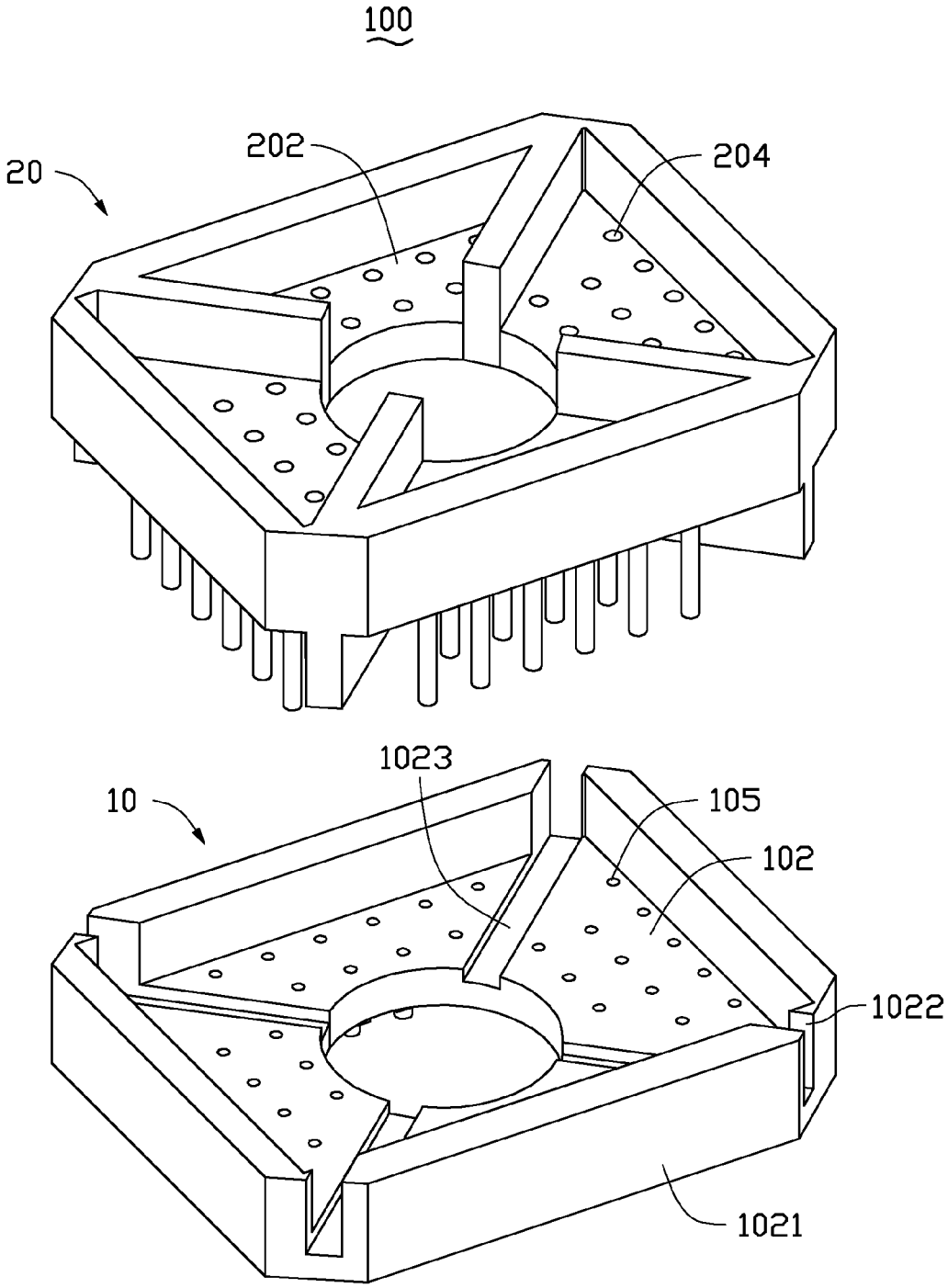
FIG. 2 is similar to FIG. 1, but viewed from another aspect.
Figure 4:
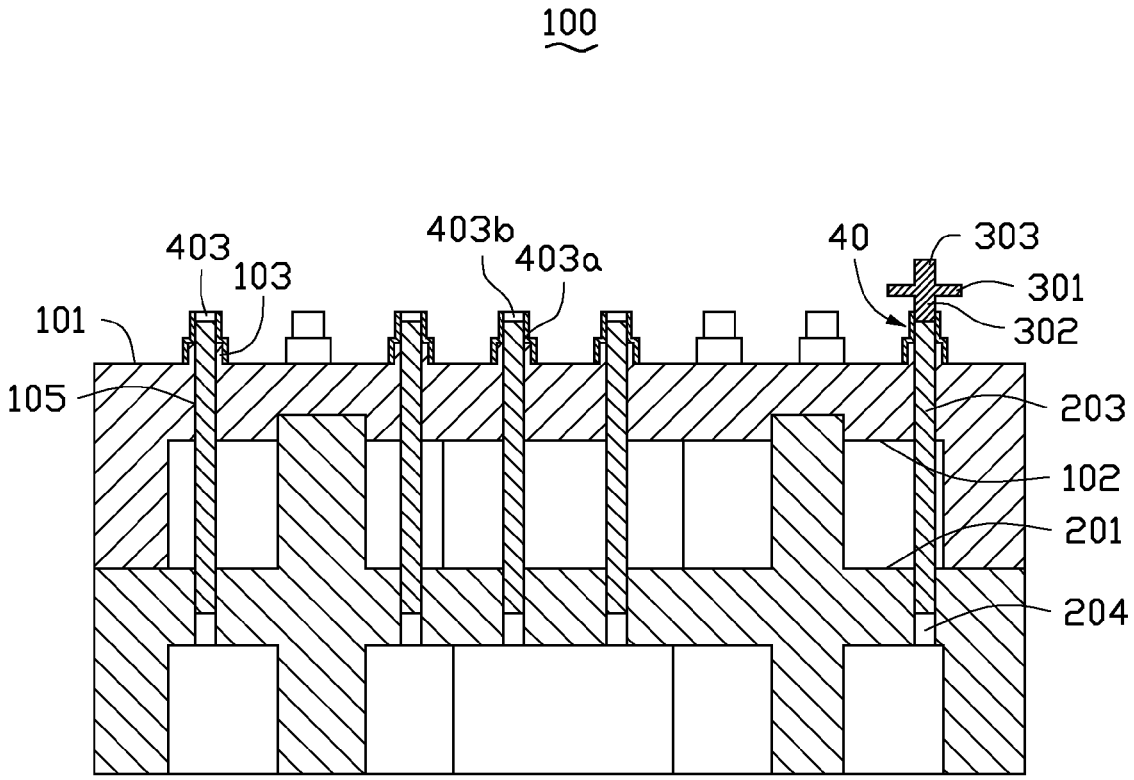
FIG. 4 is a cross-sectional view taken along line IV-IV of FIG. 3.

FIGS. 1, 2, and 4 show a coating auxiliary device 100, according to a first embodiment. The coating auxiliary device 100 includes a loading tray 10, an ejecting plate 20, and a number of masking stoppers 30.

The loading tray 10 is generally cuboid and includes a substantially rectangular loading surface 101, a matching surface 102 opposite to the loading surface 101, and a number of engaging portions 103 extending up from the loading surface 101. The loading tray 10 defines a circular aligning hole 104, and a number of guiding holes 105. The aligning hole 104 is substantially defined in the center of the loading surface 101 and passes through the loading surface 101 and the matching surface 102. The guiding holes 105 surround the aligning hole 104. Each guiding hole 105 passes through a respective one of the engaging portions 103 and the matching surface 102.

Each engaging portion 103 is used to engage with a workpiece to be coated. In the embodiment, the workpiece is a lens barrel 40. The engaging portions 103 can be engaged with a number of lens barrels 40, respectively. The lens barrel 40 is hollow and includes a substantially cuboid base portion 401 and a substantially cylindrical receiving portion 402 coaxially connected to the base portion 401. The lens barrel 40 defines a through hole 403 passing through the base portion 401 and the receiving portion 402. The through hole 403 includes a substantially cuboid first receiving space 403*a* passing through the base portion 401 and a substantially cylindrical second receiving space 403*b* passing through the receiving portion 402. Each first receiving space 403*a* corresponds to and is used to receive a corresponding engaging portion 103, such that one end of the lens barrel 40 sleeves outside the corresponding engaging portion 103. In alternative embodiments, the first receiving space 403*a* can be cylindrical and accordingly each engaging portion 103 is cylindrical.

The loading tray 10 further includes two pairs of sidewalls 1021 extends from extend up from sides of the matching surface 102. A slot 1022 is defined between a joint of two adjacent neighboring sidewalls 1021. The matching surface 102 defines four aligning grooves 1023. Each aligning groove 1023 is in communication with the aligning hole 104 and a corresponding slot 1022. The aligning grooves 1023 are arranged in a cross around the aligning hole 104. The guiding holes 105 are distributed between every two adjacent neighboring aligning grooves 1023.

The ejecting plate 20 is generally cuboid and includes a substantially rectangular assembling surface 201, a bottom surface 202 opposite to the assembling surface 201, and a number of ejecting rods 203. The assembling surface 201 corresponds to the matching surface 102 and defines a number of mounting holes 204 passing through the assembling surface 201 and the bottom surface 202. The ejecting plate 20 further includes an aligning post 205 and four aligning ribs 206.

Each ejecting rod 203 is cylindrical and made of metal. Each mounting hole 204 corresponds to a guiding hole 105. One end of each ejecting rod 203 is mounted into a mounting hole 204 such that each ejecting rod 203 corresponds to a guiding hole 105. In alternative embodiment, each mounting hole 204 can be a blind hole. A diameter of each ejecting rod 203 is less than a diameter of a corresponding guiding hole 105. The aligning post 205 is cylindrical and extends up from the center of the assembling surface 201. A diameter of the aligning post 205 corresponds to a diameter of the aligning hole 104. The aligning ribs 206 extend up from the assembling surface 201 and are arranged in a cross. One end of each aligning rib 206 is connected to the aligning post 205. Each aligning rib 206 corresponds to an aligning groove 1023. The ejecting rods 203 are arranged between every two adjacent neighboring aligning ribs 206. A height of each ejecting rod 203 along a directing perpendicular to the assembling surface 201 is greater than a height of the aligning post 205 and a height of each aligning rib 206.

Each masking stopper 30 is integrally formed by metal and includes a masking plate 301, an insertion portion 302, and a handle portion 303. The masking plate 301 is substantially rectangular and an area of the masking plate 301 is greater than an area of a cross surface of the receiving portion 402. The insertion portion 302 extends from the center of one surface of the masking plate 301. The insertion portion 302 corresponds to the second receiving space 403*b* in shape. The handle portion 303 extends up from the other surface opposite to the insertion portion 302 of the masking plate 301.

When coating the lens barrels 40, each engaging portion 103 is received in the first receiving space 403*a* of each lens barrel 40, namely one end of the each lens barrel 40 sleeves outside each engaging portion 103. Each guiding hole 105 is in communication with the through hole 403 of a respective lens barrel 40. An operator clamps the handle portion 303 and inserts the insertion portion 302 of each masking stopper 30 into the second receiving space 403*b*. Therefore, each lens barrel 40 is enclosed by the masking plate 301 of a respective mask stopper 30. Then an exterior surface of each lens barrel 40 is coated with a layer of metallic film. During coating, each masking stopper 30 can prevent an interior surface of a respective lens barrel 40 from being coated and contaminated.

Figure 3:
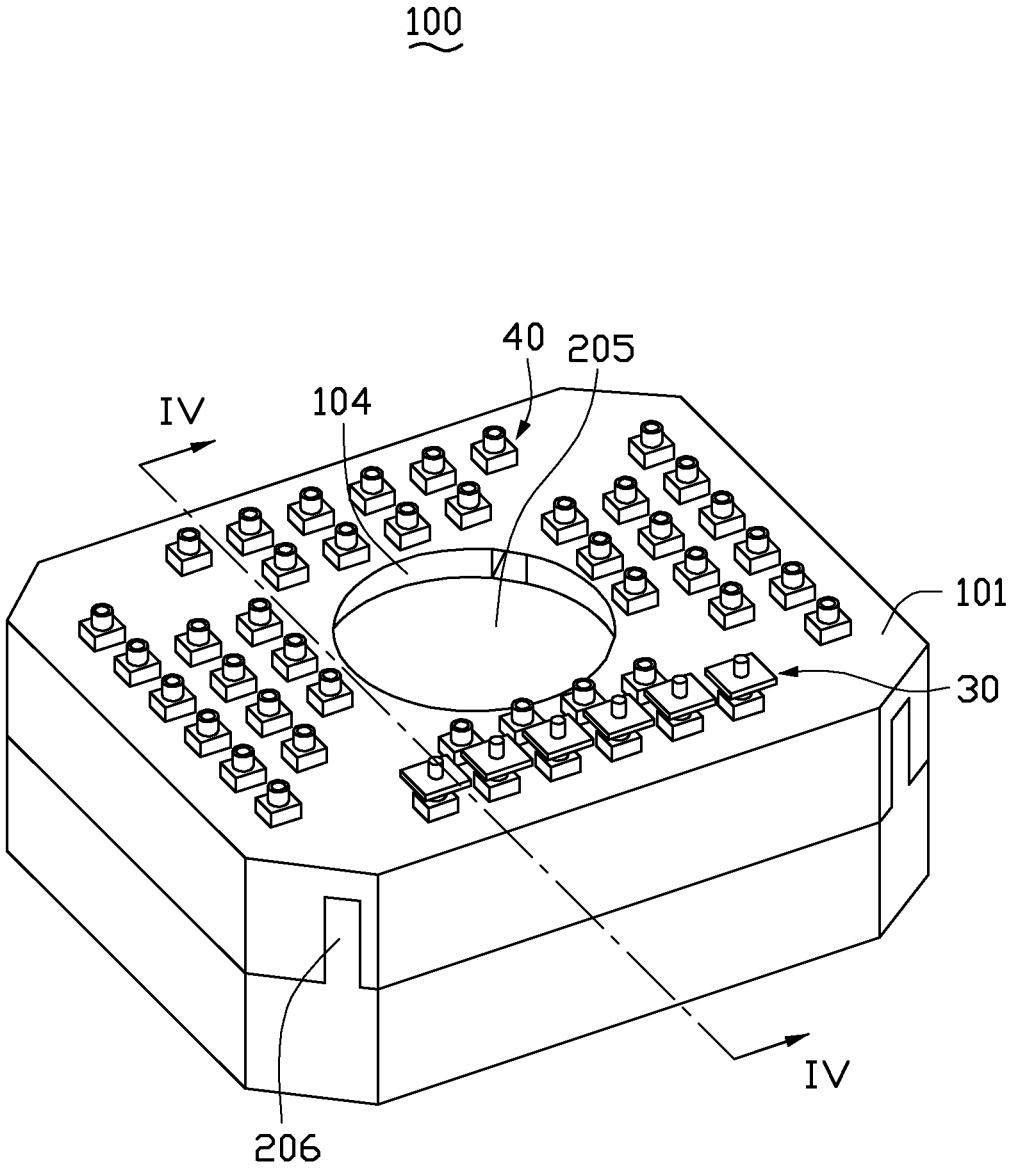
FIG. 3 is an assembled view of the coating auxiliary device of FIG. 1.

Also referring to FIGS. 3 and 4, after coating the lens barrels 40, the ejecting plate 20 is assembled with the loading tray 10. The sidewalls 1021 are seated on the assembling surface 201 and the matching surface 102 faces the assembling surface 201. The aligning post 205 is received in the aligning hole 104. Each aligning rib 206 is received in a respective aligning groove 1023. Each ejecting rod 203 is guided into a respective guiding hole 105 from the matching surface 102. A distal end of each ejecting rod 203 extends into the receiving space 403*b* to press on the insertion portion 302 of a respective masking stopper 30. Such that each masking stopper 30 is ejected out from a lens barrel 40 by a respective ejecting rod 203. By employing the coating auxiliary device 100, efficiency is significantly increased for ejecting the masking stoppers 30 out from the lens barrels 40.

In alternative embodiments, the handle portion 303 can be omitted. The operator clamps the masking plate 301 to insert the insertion portion 302 into the second receiving space 403*b* of a respective lens barrel 40.

In alternative embodiments, the aligning post 205 can be omitted. Accordingly the loading tray 10 does not define the aligning hole 104.

In alternative embodiment, the number of the aligning ribs 206 is not limited by four and can be at least one. Accordingly the number of the aligning groove 1023 can be at least one.

In alternative embodiments, the ejecting rods 203 can be integrally formed with the ejecting plate 20 and extend up from the assembling surface 201.

Figure 5:
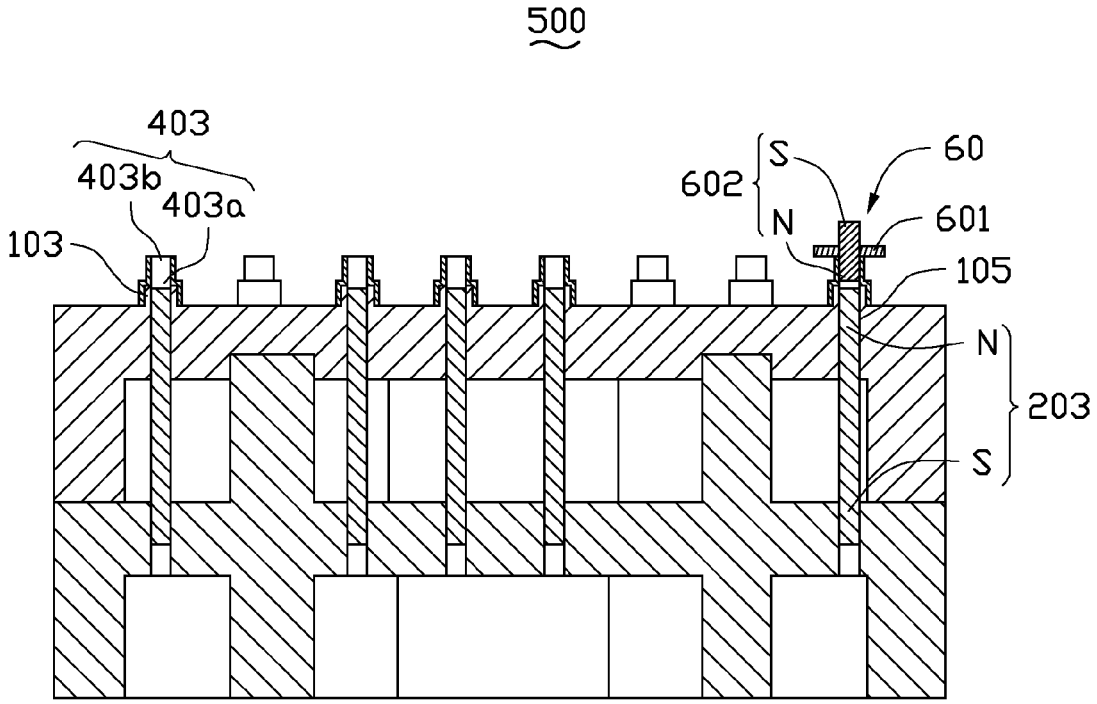
FIG. 5 is a cross-sectional view of a coating auxiliary device, in according with a second embodiment.

Referring to FIG. 5, a coating auxiliary device 500, according to a second embodiment. The coating auxiliary device 500 according to the second embodiment is similar to the coating auxiliary device 100 according to the first embodiment, except that the coating auxiliary device 500 includes a number of masking stoppers 60 instead of the masking stoppers 30 in the first embodiment. Each masking stopper 60 includes a rectangular masking plate 601 and a cylindrical first magnet 602. The masking plate 601 is made of metal. The first magnet 602 passes through the masking plate 601 and is clamped by the masking plate 601. The N polarity of the first magnet 602 is inserted into the second receiving space 403*b*. The S polarity of the first magnet 602 is served as the handle portion 303. Each ejecting rod 203 is a second magnet. The second magnet 203 is cylindrical and the S polarity of the second magnet 203 is mounted to a respective mounting hole 204. The second magnet 203 is guided into a respective guiding hole 105 with the N polarity of the second magnet 203 facing the N polarity of the first magnet 602. In this embodiment, the N polarity of the second magnet 203 needn't press on the N polarity of the first magnet 602. Each masking stopper 60 is ejected out from a lens barrel 40 by magnetic repulsion force between a respective second magnet 203 and a respective first magnet 602.

While various embodiments have been described, it is to be understood that the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. A coating auxiliary device for coating a plurality of hollow workpieces, comprising:

a loading tray comprising a loading surface, a matching surface opposite to the loading surface, and a plurality of engaging portions extending up from the loading surface, each engaging portion configured to engage with a respective one of the workpieces, the loading tray defining a plurality of guiding holes, each guiding hole passing through a respective one of the engaging portions and the matching surface and being in communication with each workpiece;

a plurality of masking stoppers, each masking stopper being configured to partially insert into a respective workpiece to mask an interior of the respective workpiece; and an ejecting plate comprising an assembling surface and a plurality of ejecting rods extending up from the assembling surface;

wherein each ejecting rod is configured to be guided into a respective one of the guiding holes from the matching surface to eject a respective masking stopper out from a respective workpiece.

2. The coating auxiliary device of claim 1, wherein each masking stopper comprises a rectangular masking plate and a cylindrical insertion portion extending from a center of one surface of the masking plate, and the insertion portion is configured to be inserted into the respective workpiece.

3. The coating auxiliary device of claim 2, wherein each masking stopper further comprises a cylindrical handle portion extending from another surface opposite to the insertion portion; the masking plate, the insertion portion, and the handle portion are integrally formed with each other.

4. The coating auxiliary device of claim 2, wherein the assembling surface defines a plurality of mounting holes, each ejecting rod is cylindrical and is mounted to a respective one of the mounting holes, and a distal end of each ejecting rod is configured to press on the insertion portion.

5. The coating auxiliary device of claim 2, wherein the workpieces are lens barrels, each lens barrel comprises a cuboid base portion and a cylindrical receiving portion connected to the base portion, the engaging portion is cuboid, the base portion is configured to sleeve outside a respective engaging portion, and the insertion portion is configured to be inserted into the receiving portion.

6. The coating auxiliary device of claim 1, wherein each masking stopper comprises a rectangular masking plate and a cylindrical first magnet, the first magnet passes through the masking plate and is clamped by the masking plate, and the N polarity of the first magnet is configured for being inserted into the respective workpiece.

7. The coating auxiliary device of claim 6, wherein each ejecting rods is a cylindrical second magnet, the S polarity of the second magnet is mounted to the assembling surface, and the N polarity of the second magnet is configured to face the N polarity of the first magnet.

8. The coating auxiliary device of claim 1, wherein the ejecting plate comprises a cylindrical aligning post extending up from the center of the assembling surface, and the loading tray defines an aligning hole configured to receive the aligning post.

9. The coating auxiliary device of claim 8, wherein the ejecting plate further comprises at least one aligning rib extending up from the assembling surface, and the matching surface defines at least one aligning groove configured to receive the at least one aligning rib.

10. The coating auxiliary device of claim 9, wherein the at least one aligning rib comprises four ribs, and the four ribs are arranged in a cross around the aligning post; the at least one aligning groove comprises four aligning grooves, and the four grooves are arranged in a cross around the aligning hole.

11. The coating auxiliary device of claim 10, wherein one end of each aligning rib is connected to the aligning post, and one end of each aligning groove is in communication with the aligning hole.

12. The coating auxiliary device of claim 11, wherein the ejecting plate comprises a plurality of sidewalls extending up from sides of the matching surface, each two adjacent sidewall define a slot, and the slot is in communication with a respective aligning groove and is configured to receive a respective aligning rib.

* * * * *